US005752457A

United States Patent [19]

Hart et al.

[11] Patent Number: 5,752,457

[45] Date of Patent: May 19, 1998

[54] TUFTING MACHINE HAVING IMPROVED NEEDLE STROKE ADJUSTMENT

[75] Inventors: Christopher William Hart; Paul Dreager Grant, both of Accrington, England

[73] Assignee: G.T. Supplies & Engineering (ACC) Ltd., Accrington, England

[21] Appl. No.: 750,558

[22] PCT Filed: Jun. 14, 1995

[86] PCT No.: PCT/GB95/01385

§ 371 Date: Dec. 13, 1996

§ 102(e) Date: Dec. 13, 1996

[87] PCT Pub. No.: WO95/34706

PCT Pub. Date: Dec. 21, 1995

[30] Foreign Application Priority Data

Jun. 14, 1994 [GB] United Kingdom ..... 9411888

[51] Int. Cl.[6] ..... D05C 15/20

[52] U.S. Cl. ..... 112/80.42

[58] Field of Search ..... 112/221, 80.01, 112/80.42

[56] References Cited

U.S. PATENT DOCUMENTS 3,839,972 10/1974 Scott et al. .

3,857,345 12/1974 Higgins .

FOREIGN PATENT DOCUMENTS 2 055 913 7/1980 United Kingdom .

2 125 447 7/1983 United Kingdom .

WO 90/06391 7/1990 WIPO .

*Primary Examiner*—Paul C. Lewis

*Attorney, Agent, or Firm*—Richard E. Jenkins, P.A.

[57] ABSTRACT

A tufting machine comprising a drive shaft, an eccentric rotatable by the drive shaft, a connecting member (6) mounted at its proximal end for rotation about the eccentric (4) and coupled at its distal end to pushing means (26) for pivotal movement in relation thereto, a needle mounting means associated, for reciprocating movement, with the said pushing means (26) which impart the reciprocation to the needle mounting means under the impulse of the connecting member (6). The connecting member comprises at least two parts, a distal part (22) for engaging the pushing means and an adjustable proximal part (24) for engaging the said eccentric, the adjustment being possible by varying the position of the proximal part with respect to at least a part of the said eccentric (4). The variation may be provided by a split eccentric with inward facing grooves (10, 12) on the two parts to vary the relative position and thus the focus of the eccentric may be varied without providing a replacement eccentric.

4 Claims, 3 Drawing Sheets

TUFTING MACHINE HAVING IMPROVED NEEDLE STROKE ADJUSTMENT

This invention relates to tufting machines and, in particular, it relates to tufting machines having improved needle stroke adjustment.

BACKGROUND OF THE INVENTION

At present, tufting machine needle stroke adjustment is carried out by removing the eccentric and fitting the replacement. The process can be somewhat lengthy and requires resetting of the dead position for the needle stroke. For this reason, the change over is often avoided and results in the necessity for operation at lower speeds and for less economic carpet manufacture. GB-A-2 125 447 discloses a tufting machine as set out in the preamble to claim 1. U.S. Pat. No. 3,857,345 discloses a tufting machine with an adjustable eccentric but the method of adjustment is inconvenient and comprises two adjustment steps.

SUMMARY OF THE INVENTION

According to a first aspect of the present invention there is provided a tufting machine comprising a drive shaft (50), an eccentric (4) rotatable by the said drive shaft (50), a connecting rod (6) mounted at the proximal end thereof for rotation about the said eccentric and coupled at the distal end thereof to pushing means (26) for pivotal movement in relation thereto, a needle mounting means (28) associated, for reciprocating movement, with the said pushing means which impart the reciprocation to the needle mounting means under the impulse of the connecting rod, characterised in that the connecting rod comprises at least two pieces (22,24), a distal piece (22) for engaging the pushing means and an adjustable proximal piece (24) for engaging the said eccentric, the adjustment being possible by varying the position of the proximal piece (24) with respect to at least a part of the said eccentric.

Preferably, the connecting rod proximal part and the connecting rod distal part are connected by means of a first variable position coupling in a manner that allows for the varying of the position of the proximal part with respect to the said at least part of the said eccentric and, preferably, which retains the position of the said distal part.

However, the said variation of the said connecting rod proximal part position may be effected by other means such as a variable position coupling of the proximal part to a third connecting rod part which also connects the proximal part with the distal part. Preferably, the said variable position coupling comprises an interlocking portion. The interlocking portion, typically comprises a series of parallel grooves or serrations located on each of the serrations, preferably, extend substantially at right angles to the direction of reciprocal movement so that the coupling of the grooves or serrations can withstand the force imparted from such movement.

Preferably, the varying of the position of the proximal part with respect to at least a part of the eccentric is effected by way of a second variable position coupling between an inner portion of the eccentric mounted for rotation about the end of a shaft and an outer portion of the eccentric to which the proximal end of the connecting member is mounted. Preferably, the said second variable position coupling comprises an interlocking portion. The interlocking portion typically comprises a series of parallel grooves or serrations located on each of the engaging faces of the said parts. Each of the grooves or serrations, preferably, extend substantially at right angles to the direction of reciprocating movement, when the needles are in the bottom dead position, so that the coupling of the grooves or serrations can withstand the force imparted from such movement.

Preferably, the eccentric comprises at least two parts, the relative position of the two parts being variable so as to permit variable eccentric motion. Preferably, the first of the said two parts is coupled directly to the connecting rod and the second of the said two parts is coupled directly to a crank member.

Preferably, the variation in the relative position of the two parts is effected by an interlocking portion. The interlocking portion typically comprises a series of parallel grooves or serrations located on each of the engaging faces of the said parts. Each of the grooves or serrations, preferably, extend substantially at right angles to the direction of reciprocating movement, when the needles are in the bottom dead position, so that the coupling of the grooves or serrations can withstand the force imparted from such movement.

In operation, due to rotation of the eccentric, forces will act along, as well as across, the grooves or serrations.

Thus, in such an embodiment it is necessary to reinforce the coupling against forces acting along the grooves or serrations.

Preferably, the inner and outer portion of the said eccentric have a further interlocking member orientated so as to withstand forces acting along the said grooves or serrations.

The proximal and distal portions of the connecting member and also the inner and outer portions of the eccentrics may be easily de-coupled and the relative positions of the said inner and outer eccentric portions adjusted and then re-coupled.

Preferably, the said interlocking portions or serrations on both the eccentric and connecting member are of the same magnitude so that the proximal portion may be simultaneously adjusted and re-coupled relative to the inner eccentric portion and the distal portion of the connecting member.

The invention allows variation in the locus described by the eccentric and thus permits variation in the needle stroke without the need for a replacement eccentric.

A further advantage of the invention is the obviation of the need to adjust the bottom dead position during eccentric adjustment. This is possible because the distal portion of the connecting rod is unaffected by eccentric adjustment due to the two-piece connecting rod.

Thus the invention provides for an increased speed of needle stroke adjustment. This is particularly important in applications where the use of a cam is required for creating increased shading or patterns in the carpet product. Previously, in such cases, the changeover of the cam was avoided because of the lengthy operation of changeover. However, when tufting machines use cams the high speeds are not possible and thus, due to the combination of a cam and the difficulties in change-over, lower speeds are operated throughout even though the cam is only used for a small proportion of the tufts. The invention alleviates this problem allowing for quick changeover of the eccentric and thus allows for operation of the lower speed for tufts requiring cams and a switch over to high speeds for the remainder of the tufts or vice versa. The invention thus provides for a much greater efficiency and speed of operation with a resulting saving in cost.

Preferably, there are at least two eccentrics actuated by a common main shaft by way of a crank member. preferably, a drive wheel on the main shaft rotates the said crank member by way of a driven wheel on the crank member.

Preferably, the eccentrics are disposed at either end of the said crank member and typically there is a series of such cranks spaces at intervals along the length of the tufting machine and parallel to the common main drive shaft. Typically, each said crank has two eccentrics disposed one at each end thereof.

The driving means is, preferably, a chain. Typically, an inverted tooth chain (ITC) is utilised. The ITC is able to transmit very high speeds to the crank. Up to 1500 rpm have been achieved. The ITC is also very strong transmitting up to 22 kw per chain.

The ITC offers considerable advantages over gear and timing belt engagements. The ITC can be operated at higher speeds by providing improved contact and pressure lubrication.

Such high speeds are not known in modern tufting machine technology and are also partially due to a combination of a well balance driving mechanism provided by a series of spaced crank members rather than a continuous common crank or a direct drive mechanism. In addition, high speeds are possible due to the use of an ITC to drive the crank members from the main drive shaft. Furthermore, high speeds are possible due to the strong interlocking grooves or serrations on the proximal and distal portions of the connecting rods.

Typically, the cranks, eccentrics, and connecting rods are easily accessible by way of an access port which is positioned over each crank member.

In operation, the access port may be covered by a sliding or hinge door which is, preferably, transparent.

Preferably, an elongated slot is located in the connecting rod and the portion of the eccentric to which the said connecting rod is mounted so that the position thereof can be varied with respect to the portion of the eccentric which is coupled to the crank member by variation in the position of the coupling bolt.

BRIEF DESCRIPTION OF THE DRAWINGS

Embodiments of the invention will now be described by way of example only and with reference to the accompany drawings in which.

DETAILED DESCRIPTION OF THE PREFERRED EMBODIMENT

Figure 1:
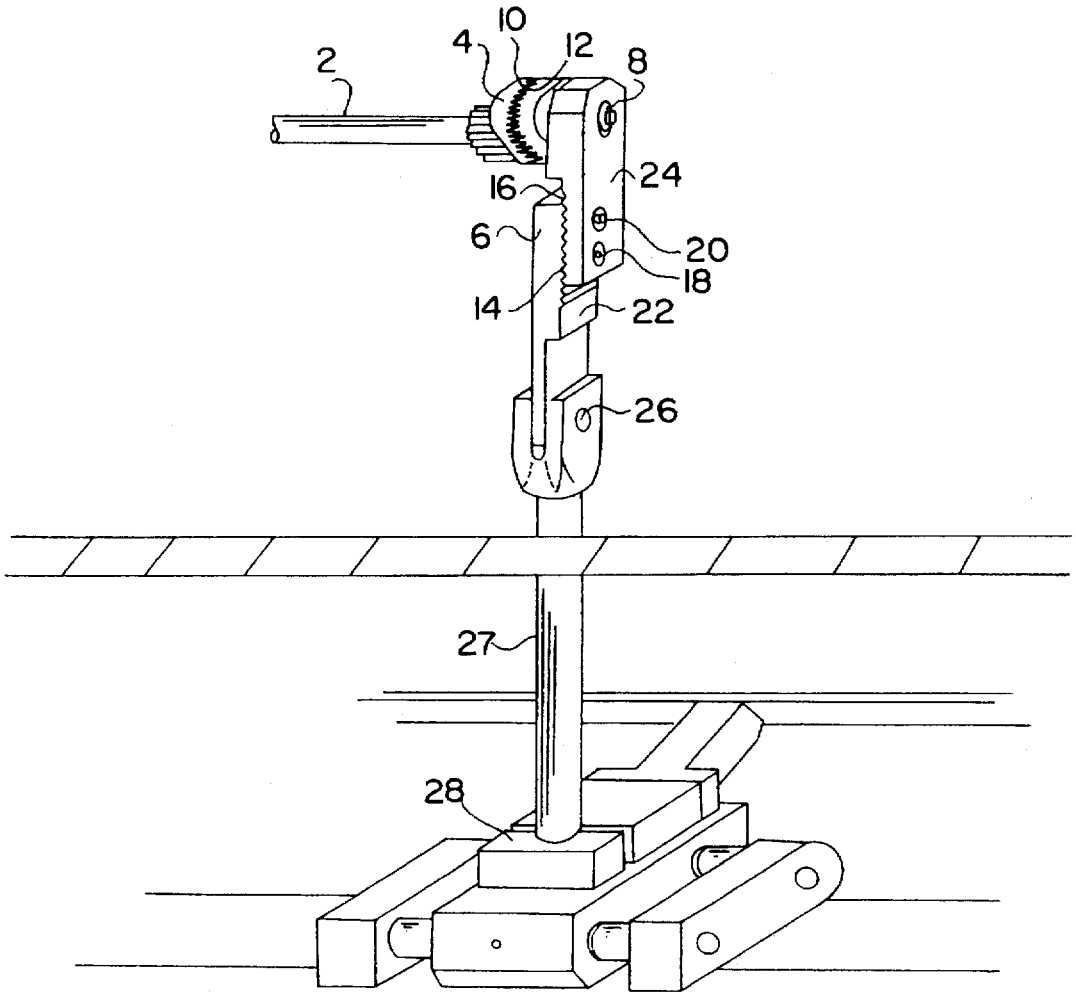
FIG. 1 shows a single needle stroke adjustment system.

Referring to FIG. 1 a crank member 2 actuates an adjustable eccentric 4 disposed at the end of the crank shaft and coupled to a connecting rod 6 by way of a capped pin 8. The adjustable eccentric 4 and connecting rod 6 are both divided into two interlocking halves, the interlocking being effected by mutually co-operating serrations located on each of the co-engaging faces 10, 12 of the eccentric and each of the co-engaging faces 14, 16 of the connecting rod. The co-engaging faces of the connecting rod are held together by two pins 18 and 20 and thus the lower 22 and upper 24 portion of the connecting rod are securely held together. A pin 26 couples the lower connecting rod 22 to a push rod 27 which latter is coupled to a slidable needle bar 28.

Figure 2:
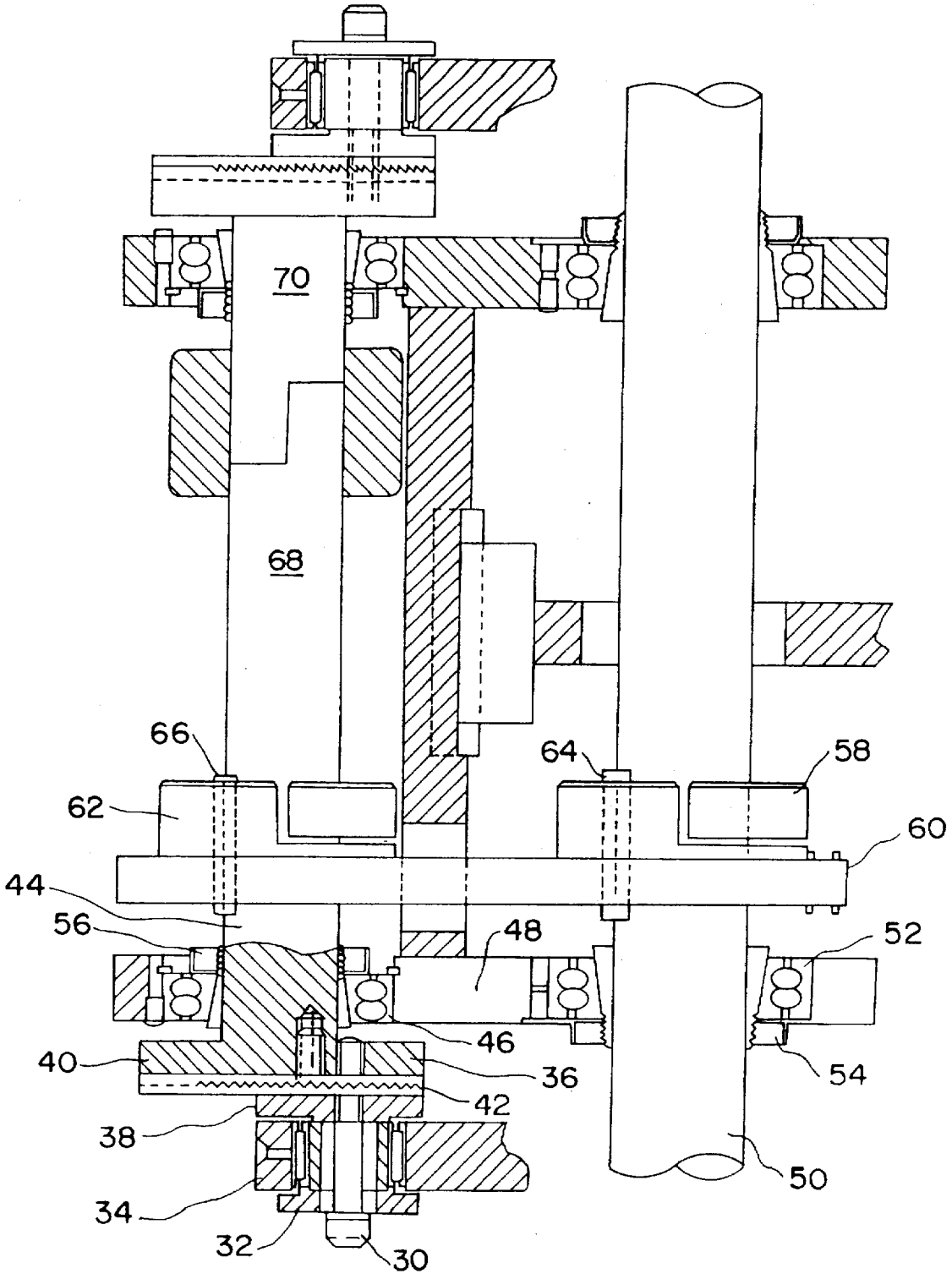
FIG. 2 shows a cross sectional view through a twin eccentric crank and bracket.

Referring to FIG. 2, wherein an alternative embodiment of the invention is shown, a head bolt **3*b* secures a spring washer 32 to the connecting rod 34 and the shank of the bolt secures the connecting rod 34 to the eccentric 36. The eccentric is split into two portions 38 and 40 which two portions engage each other by way of mutually co-engaging serrations 42. The eccentric is located on the end of a crank shaft 44 which crank shaft is supported by a bearing wheel 46 located in a bracket 48. The main drive shaft 50 is also supported in the same bracket by a bearing wheel 52. Both the main drive shaft and the crank shaft are secured by bolts 54 and 56 respectively. The crank shaft is parallel and spaced from the main drive shaft 50. The main drive shaft has a drive wheel 58 for driving a chain 60 which chain rotates a driven wheel 62 on the crank shaft 44. The wheels 58 and 62 are respectively held in position by securing bars 64 and 66 respectively which fit into accommodating grooves in the main drive shaft and crank shaft and the surrounding wheels respectively. The crank shaft is in two portions a driven wheel shaft 68 and a connecting shaft 70**. In all other respects the crank shaft is symmetrical with the eccentrics, connecting rod and connecting means matching those earlier described on the driven wheel portion of the crank shaft.

Figure 3:
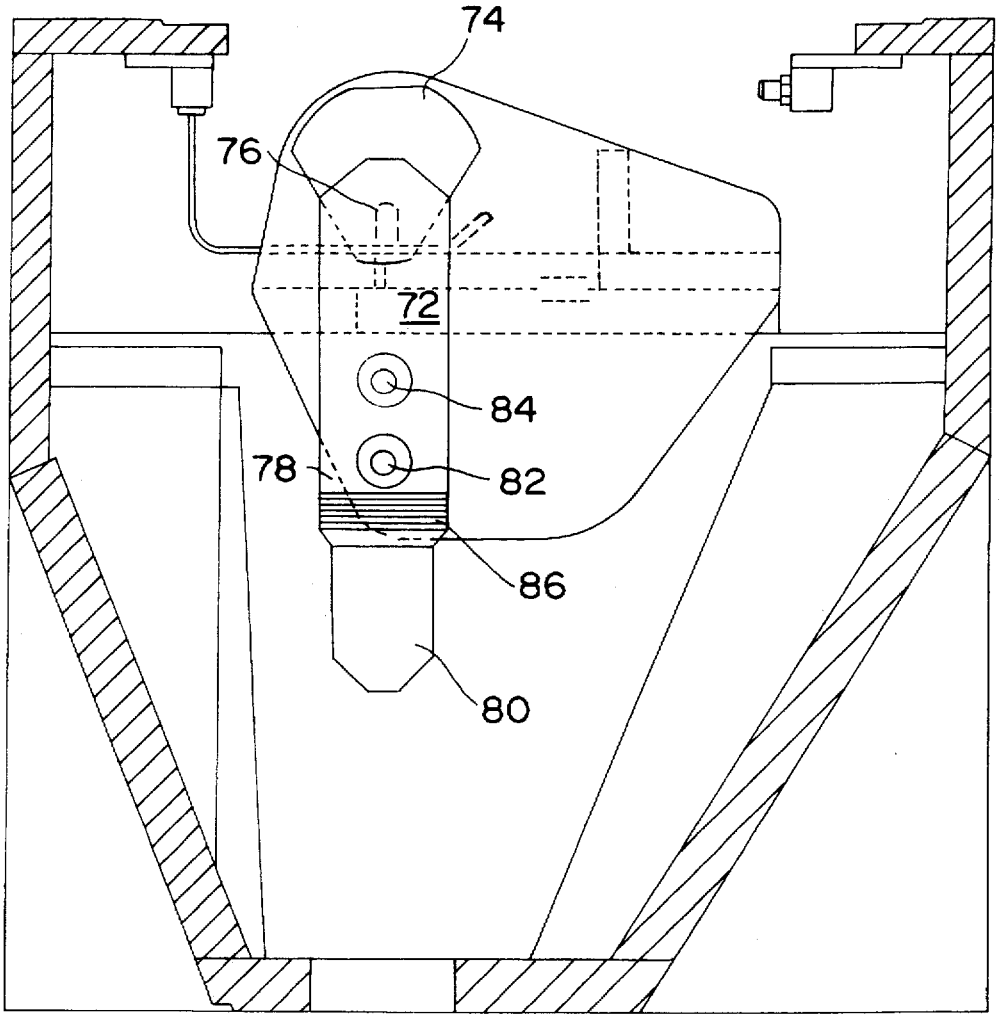
FIG. 3 shows a partial side elevation of a connecting rod fitting in the machine housing.

Referring to FIG. 3, wherein an alternative embodiment of the invention is shown, a connecting rod 72 engages with an eccentric 74 by way of co-engaging serrations (not shown) and a connecting bolt which passes through an elongated aperture 76 which aperture permits variation in the positioning of the connecting rod 72 with respect to the eccentric 74. The upper portion 78 of the connecting rod 72 is connected to the lower portion 80 thereof by way of connecting bolts 82 and 84. The upper portion of the face of the said lower portion 80 has extending laterally across the surface a series of serrations 86 which combine with accommodating serrations on the inner face of the lower portion of the upper portion 78 of the connecting rod 72 and thereby provide resistance against the upward and downward forces acting on the connecting rod during operation of the needle stroke. The serrations on the matching halves of the eccentric 74 act in a similar manner and thus the serrations and elongated aperture 76 provide for variation in the eccentric by adjusting the position of the upper connecting rod with respect to the lower portion of the connecting rod and the inner eccentric respectively.

Various modifications and alterations of the invention can be carried out without departing from the invention as described.

We claim:

1. A tufting machine comprising a drive shaft (50), an eccentric (4) rotatable by the said drive shaft (50), a connecting rod (6) mounted at a proximal end of said connecting rod for rotation about the said eccentric and coupled at a distal end thereof to pushing means (26) for pivotal movement in relation thereto, a needle mounting means (28) associated, for reciprocating movement, with the said pushing means which impart the reciprocation to the needle mounting means under the impulse of the connecting rod, characterised in that the connecting rod comprises at least two pieces (22, 24), a distal piece (22) for engaging the pushing means and an adjustable proximal piece (24) for engaging the said eccentric, a variable position coupling providing the engagement between the proximal piece and at least a part of the said eccentric so that the adjustment is possible by varying a coupling position of the proximal piece (24) with respect to at least a part of the said eccentric.

2. A tufting machine comprising a drive shaft (50), an eccentric (4) rotatable by the said drive shaft (50), connecting rod (6) mounted at a proximal end of said connecting rod for rotation about the said eccentric and coupled at a distal end thereof to pushing means (26) for pivotal movement in relation thereto, a needle mounting means (28) associated, for reciprocating movement, with the said pushing means which impart the reciprocation to the needle mounting means under the impulse of the connecting rod, characterised in that the connecting rod comprises at least two pieces (22, 24), a distal piece (22) for engaging the pushing means and an adjustable proximal piece (24) for engaging the said eccentric, the adjustment being possible by varying a position of the proximal piece (24) with respect to at least a part of the said eccentric, wherein the connecting rod proximal piece and the connecting rod distal piece are connected by means of a first variable position coupling in a manner that allows for the varying of the position of the proximal piece with respect to the said at least part of the said eccentric, wherein the varying of the position of the proximal piece with respect to at least a part of the eccentric is affected by way of a second variable position coupling (42) between an inner portion of the eccentric (40) mounted for rotation about an end of a shaft (68) and an outer portion of the eccentric (38) to which the proximal end of the connecting rod is mounted, wherein both the first and second variable position couplings comprise an interlocking portion (10, 12, 42, and 14, 16) and wherein the interlocking portions on both the eccentric and connecting rod are of the same magnitude so that the proximal piece may be simultaneously adjusted and recoupled relative to both the inner eccentric portion and the distal piece of the connecting rod.

3. A tufting machine comprising a drive shaft (50), an eccentric (4) rotatable by the said drive shaft (50), a connecting rod (6) mounted at a proximal end of said connecting rod for rotation about the said eccentric and coupled at a distal end thereof to pushing means (26) for pivotal movement in relation thereto, a needle mounting means (28) associated, for reciprocating movement, with the said pushing means which impart the reciprocation to the needle mounting means under the impulse of the connecting rod, characterised in that the connecting rod comprises at least two pieces (22, 24), a distal piece (22) for engaging the pushing means and an adjustable proximal piece (24) for engaging the said eccentric, the adjustment being possible by varying a position of the proximal piece (24) with respect to at least a part of the said eccentric, wherein the connecting rod proximal piece and the connecting rod distal piece are connected by means of a first variable position coupling in a manner that allows for the varying of the position of the proximal piece with respect to the said at least part of the said eccentric, wherein the varying of the position of the proximal piece with respect to at least a part of the eccentric is affected by way of a second variable position coupling (42) between an inner portion of the eccentric (40) mounted for rotation about an end of a shaft (68) and an outer portion of the eccentric (38) to which the proximal end of the connecting rod is mounted, wherein both the first and second variable position couplings comprise an interlocking portion (10, 12, 42, and 14, 16) and wherein the interlocking portions on both the eccentric and connecting rod are of the same magnitude so that the proximal piece may be simultaneously adjusted and recoupled relative to both the inner eccentric portion and the distal piece of the connecting rod, the interlocking portions further comprising engaging faces on each of the interlocking portions, wherein the interlocking portions comprise a series of parallel grooves or serrations located on each of the engaging faces of the said interlocking portions.

4. A tufting machine comprising a drive shaft (50), an eccentric (4) rotatable by the said drive shaft (50), a connecting rod (6) mounted at a proximal end of said connecting rod for rotation about the said eccentric and coupled at a distal end thereof to pushing means (26) for pivotal movement in relation thereto, a needle mounting means (28) associated, for reciprocating movement, with the said pushing means which impart the reciprocation to the needle mounting means under the impulse of the connecting rod, characterised in that the connecting rod comprises at least two pieces (22, 24), a distal piece (22) for engaging the pushing means and an adjustable proximal piece (24) for engaging the said eccentric, the adjustment being possible by varying a position of the proximal piece (24) with respect to at least a part of the said eccentric, wherein the connecting rod proximal piece and the connecting rod distal piece are connected by means of a first variable position coupling in a manner that allows for the varying of the position of the proximal piece with respect to the said at least part of the said eccentric, wherein the varying of the position of the proximal piece with respect to at least a part of the eccentric is affected by way of a second variable position coupling (42) between an inner portion of the eccentric (40) mounted for rotation about an end of a shaft (68) and an outer portion of the eccentric (38) to which the proximal end of the connecting rod is mounted, wherein both the first and second variable position couplings comprise an interlocking portion (10, 12, 42, and 14, 16) and wherein the interlocking portions on both the eccentric and connecting rod are of the same magnitude so that the proximal piece may be simultaneously adjusted and recoupled relative to both the inner eccentric portion and the distal piece of the connecting rod, the interlocking portions further comprising engaging faces on each of the interlocking portions, wherein the interlocking portions comprise a series of parallel grooves or serrations located on each of the engaging faces of the said interlocking portions, wherein the grooves or serrations extend substantially at right angles to the direction of reciprocal movement.

* * * * *